US012043453B2

(12) United States Patent
Rice

(10) Patent No.: US 12,043,453 B2
(45) Date of Patent: Jul. 23, 2024

(54) MULTI-COMPARTMENT CONTAINER WITH BALL DETENT LID CLOSURE AND STOPPAGE FEATURE

(71) Applicant: Charmwood Chargers LLC, Coconut Grove, FL (US)

(72) Inventor: Tavish McIver Rice, Washington, DC (US)

(73) Assignee: Charmwood Chargers LLC, Coconut Grove, FL (US)

( * ) Notice: Subject to any disclaimer, the term of this patent is extended or adjusted under 35 U.S.C. 154(b) by 6 days.

(21) Appl. No.: 18/132,384

(22) Filed: Apr. 8, 2023

(65) Prior Publication Data

US 2023/0399152 A1 Dec. 14, 2023

Related U.S. Application Data

(60) Provisional application No. 63/350,860, filed on Jun. 9, 2022.

(51) Int. Cl.
*B65D 43/12* (2006.01)
*B65D 25/04* (2006.01)

(52) U.S. Cl.
CPC ..... *B65D 43/12* (2013.01); *B65D 25/04* (2013.01); *B65D 2251/026* (2013.01);
(Continued)

(58) Field of Classification Search
CPC ..... B65D 2251/026; B65D 43/12; B65D 43/0025; B65D 41/026
(Continued)

(56) References Cited

U.S. PATENT DOCUMENTS 1,507,110 A * 9/1924 Duncan ..... B65D 43/12 16/326
1,866,183 A * 7/1932 Wardwell ..... B65D 55/12 292/261

(Continued)

FOREIGN PATENT DOCUMENTS

CA 2756365 5/2012
CN 102227354 10/2011

(Continued)

OTHER PUBLICATIONS

"3.14"×1.35" Rectangular Slider Tin", Web, <https://www.specialtybottle.com/metal-tin-containers/slider/tsld1-2?gclid=CjwKCAjwj42UBhAAEiwACIhADpZTt00x2VISasebdv7NRhvl6Kr0XR8UMLZ4Q7Gd3yZ1fQIRNgi2sBoC9kEQAvD_BwE>, retrieved May 18, 2022.

(Continued)

*Primary Examiner* — Ernesto A Grano

(57) ABSTRACT

The present invention relates to a container with multiple compartments arranged in a linear pattern between four container walls. A lid may be configured at a container top. The lid may be closed to conceal all the compartments. The lid may be opened to expose the compartments. The lid may be partially opened to expose some of the compartments and conceal some of the compartments. The lid may slide along the container top parallel to a container bottom. The container may have a ball detent wherein a spring biases a ball towards the container top whereby a protruding ball portion of the ball is received by a ball detent receiver configured in a lid bottom. As the lid slides along the container top, the protruding ball portion may enter divots of the ball detent receiver, thereby stopping the lid at multiple partially closed positions.

17 Claims, 7 Drawing Sheets

(52) U.S. Cl.
CPC .. *B65D 2251/04* (2013.01); *B65D 2543/0025* (2013.01); *B65D 2543/00277* (2013.01)

(58) Field of Classification Search
USPC ..... 220/345.3
See application file for complete search history.

(56) References Cited

U.S. PATENT DOCUMENTS

| | | | | |
|---|---|---|---|---|
| 2,828,005 | A | 3/1958 | Ricke | |
| 3,085,679 | A | 4/1963 | Burrell | |
| 3,527,373 | A * | 9/1970 | Giraudet | B65D 43/12 220/345.1 |
| 4,007,828 | A | 2/1977 | Mayled | |
| 4,083,452 | A | 4/1978 | Rossmo | |
| 4,124,143 | A | 11/1978 | Thomas | |
| 4,165,709 | A | 8/1979 | Studer | |
| 4,284,204 | A | 8/1981 | Carey, Jr. | |
| 4,615,461 | A * | 10/1986 | Liu | H05K 13/0084 220/815 |
| 5,226,539 | A | 7/1993 | Cheng | |
| 5,275,291 | A | 1/1994 | Sledge | |
| 5,577,629 | A * | 11/1996 | Rosler | B25H 3/023 220/345.3 |
| 7,721,908 | B2 | 5/2010 | Cronin et al. | |
| 8,123,036 | B2 | 2/2012 | Luciano et al. | |
| 9,387,154 | B2 | 7/2016 | Aggarwal et al. | |
| 9,981,783 | B2 | 5/2018 | Valley et al. | |
| 10,772,805 | B2 | 9/2020 | Brady et al. | |
| 11,932,457 | B1 * | 3/2024 | Kasdon | B65D 43/12 |
| 2004/0217116 | A1 * | 11/2004 | Offerman | B65D 43/12 220/345.2 |
| 2007/0164032 | A1 * | 7/2007 | Cronin | B65D 43/12 220/345.1 |
| 2009/0223994 | A1 | 9/2009 | Getz | |
| 2009/0236262 | A1 * | 9/2009 | Shuai | F21S 4/20 206/725 |
| 2010/0072206 | A1 * | 3/2010 | Doyle | B65D 25/54 220/345.2 |
| 2011/0162990 | A1 * | 7/2011 | Stitzlein | B65D 43/12 206/427 |
| 2014/0109759 | A1 * | 4/2014 | Yokota | F15B 15/26 91/167 R |
| 2018/0178953 | A1 * | 6/2018 | Corners | B65D 5/646 |
| 2021/0086957 | A1 * | 3/2021 | Kade | B65D 65/466 |
| 2021/0300636 | A1 * | 9/2021 | Irwin | B65D 43/12 |
| 2023/0365301 | A1 * | 11/2023 | Torregano | B65D 25/06 |

FOREIGN PATENT DOCUMENTS

| | | |
|---|---|---|
| EP | 2219973 | 8/2010 |
| EP | 3119107 | 1/2017 |
| WO | 2001055001 | 8/2001 |
| WO | 2021015807 | 1/2021 |

OTHER PUBLICATIONS

"Solid Carved Wood Pretty and Designer Pill Box, Jumbo Wooden Decorative Pill Box 7 Day, Weekly Pill Planner Vitamin Organizer and Pill sorter, Beech Wooden Pill Box with Sliding lid and Pill minder", Web, <https://us.amazon.com/Designer-Decorative-Planner-Vitamin-Organizer/dp/B08F16KCC3>, retrieved May 18, 2022.

"Waterproof Pill Canister", Web, <https://matadorup.com/products/waterproof-pill-canister>, retrieved Mar. 6, 2023.

"ZIKEE Large Press and Slide Open Weekly Pill Organizer, Quick Filling Pill Box 7 Day for Daily Vitamin/Medication/Supplement/Fish Oil (Black)", Web, <https://www.amazon.com/ZIKEE-Organizer-Filling-Medication-Supplement/dp/BOBBLCJ8WX/ref=cm_cr_arp_d_product_top?ie=UTF8>, retrieved Mar. 6, 2023.

"Pill Organizer 7 Day, Betife Daily Pill Box, Weekly Travel Pill Case, Cute Pill Holder to Hold Vitamins, Medicines, Pills, Supplements (Black)", Web, <https://www.amazon.com/Organizer-Betife-Vitamins-Medicines-Supplements/dp/B09PG7T581/ref=cm_cr_arp_d_product_top?ie=UTF8&th=1>, retrieved Mar. 6, 2023.

* cited by examiner

MULTI-COMPARTMENT CONTAINER WITH BALL DETENT LID CLOSURE AND STOPPAGE FEATURE

This application claims priority of U.S. provisional patent application no. 63/350,860 files on 2022 Jun. 2009, which is hereby incorporated by reference.

BACKGROUND OF THE INVENTION

The present invention relates to containers, specifically containers used to hold pills or other small objects. Many of such containers that exist in the art exist as compartmentalized containers with hinged lids. Many have multiple lids such that one lid exists for each compartment of the container. Many of said lids are held closed by closure features such as snap features that work well with hinged lids.

Other such containers in the art have sliding lids that slide relative to the rest of the container to expose the compartments of the container. These sliding lid containers may be desirable over the hinged lid containers in that they are easily opened and closed with one hand. However, many of the sliding lid containers in the art do not posses sophisticated closure mechanisms that allow the sliding lids to remain open, closed, or partially closed.

SUMMARY OF THE INVENTION

The present invention relates to a container with multiple compartments arranged in a linear pattern between four container walls. A lid may be configured at a container top. The lid may be closed to conceal all the compartments. The lid may be opened to expose the compartments. The lid may be partially opened to expose some of the compartments and conceal some of the compartments. The lid may slide along the container top parallel to a container bottom. The container may have a ball detent wherein a spring biases a ball towards the container top whereby a protruding ball portion of the ball is received by a ball detent receiver configured in a lid bottom. As the lid slides along the container top, the protruding ball portion may enter divots of the ball detent receiver, thereby stopping the lid at multiple partially closed positions.

The four container walls may be a first container wall, a second container wall, a third container wall, and a fourth container wall. The fourth container wall may be thicker than the first container wall, second container wall, and third container wall. The first container wall and third container wall may be configured parallel to each other, and perpendicular to the second container wall and fourth container wall. The second container wall and fourth container wall may be configured parallel to each other. All four container walls may be configured perpendicular to the container top and container bottom. The compartments may be enclosed by the four container walls. The compartments may be separated by compartment walls. The compartment walls may be configured perpendicular to the first container wall and third container wall, and parallel to the second container wall and fourth container wall. There may be one less compartment wall than compartments.

The number of compartments may be 2 or more, 4 or more, 7 or more, 9 or more, or any range between and including the values provided. Advantages of the exact number of compartments depends on the desired use of the container. For example, if the container is used to store medication, it may be desired for the container to have 7 compartments whereby each compartment may contain medication for one day of the week. In another example, if the container is used to store contact lenses, it may be desired for the container to have 2 compartments whereby one compartment contains contact lenses for a right eye and other compartment contains contact lenses for a corresponding left eye.

The container may have a container length that may extend from the second wall to the fourth wall. The container length may be 2 inches or more, 4 inches or more, 7 inches or more, 9 inches or more, or any range between and including the values provided. The desired container length may vary depending on the exact use of the container, as well as the number of compartments. For example, a container used to store medication may require a greater number of compartments and thereby have a greater container length than a container used to store contact lenses.

The container may have a container width that may extend from the first wall to the third wall. The container width may be 1 inch or more, 1.5 inches or more, 2 inches or more, or any range between and including the values provided. The desired container length may vary depending on the exact use of the container. For the purposes of calculating the container width when the lid is assembled onto the rest of the container, the container top may be the lid top. For the purposes of calculating the container width when the lid is disassembled from the rest of the container, the container top may be the portion of the container walls that the lid contacts when the lid slides along the container length. For the purposes of identifying the container top as a feature of the container, the container top may be either the lid top, the entire lid, the portion of the container walls that the lid contacts when the lid slides along the container length, the rails, or any combination of the features listed.

The container bottom may be configured opposite the container top. The container may have a container depth that may extend from the container top to the container bottom. The container depth may be 0.75 inches or more, 1 inch or more, 1.25 inches or more, or any range between and including the values provided. The desired container depth may vary depending on the exact use of the container, as well as the thickness of the lid.

The compartments may be arranged in a linear pattern along the container length whereby all the compartments are adjacent to the first container wall and third container wall, but only one compartment is adjacent to the second container wall and only one compartment is adjacent to the fourth container wall. When the lid slides along the container top, the lid may slide along the container length whereby the lid slides over the linear pattern of compartments. This allows the lid to expose multiple compartments at once. This provides an advantage over other similar containers that exist in the art since the container of the present invention allows for objects to be inserted into or removed from multiple compartments at once, rather than only one compartment at a time.

Rails may be configured at the container top. The rails may extend along the first container wall, the second container wall, and the third container wall. The rails may be connected to form one monolithic rail extending along the first container wall, the second container wall, and the third container wall. Rails may not extend along the fourth container wall so that the lid can be removed from and assembled onto the rest of the container, as well as slide along the container length. The rails may each have a rail recess and a rail overhang. The rail recesses may accept the lid to secure the lid to the container as the lid slides along the container length. The lid may have a lid perimeter recess.

The lid perimeter recess may receive the rail overhangs of one or more of the rails to further secure the lid to the container as the lid slides along the container length.

A ball detent may be configured within the fourth container wall. The ball detent may have a ball detent recess that may exist as a cavity within the fourth container wall. The ball detent recess may be cylindrical. The ball detent recess may alternatively be any other shape. A spring may be configured within the ball detent recess. The spring may be a linear coil spring. A ball may be configured at the end of the spring that is closest to the container top. The ball may have a protruding ball portion and a recessed ball portion. The protruding ball portion may protrude form the fourth container wall at the container top. The recessed ball portion may be recessed within the ball detent recess. The spring may expand or contract when subjected to forces, and therefore the ball may translate along the container width. Therefore, the protruding ball portion and recessed ball portion may change depending on the movement of the ball. For example, a particular point on the ball may be within the protruding ball portion when the spring is expanded, but may be within the recessed ball portion when the spring is contracted.

A ball detent receiver may be configured within the lid bottom. The lid bottom may be parallel to the lid top. The ball detent receiver may have a channel that extends in a straight line from one end of the lid to a point within the lid bottom. Divots may be configured in a linear pattern along the channel. The number of divots may be 1 greater than the number of compartments of the container. A ball detent receiver open end may be configured at the end of the channel that meets the end of the lid. The ball detent receiver may be an indentation into the lid bottom that may be the shape of half a divot. In some embodiments, the shape of the ball detent receiver open end may be half of a concave dome.

Each of the divots may have a divot depth, which is the maximum distance that the divots extend from the lid bottom towards the lid top. The ball detent receiver open end may have a ball detent receiver open end depth, which is the maximum distance that the ball detent receiver open end extends from the lid bottom towards the lid top. The divot depth of each divot may be the same as the ball detent receiver open end depth. The channel may have a channel depth, which is the maximum distance that the channel extends from the lid bottom towards the lid top. The channel depth may be less than the divot depth of each divot. The channel depth may also be less than the ball detent receiver open end depth.

The lid may be assembled to the rest of the container by receiving the lid with the rail recesses and by receiving the rail overhangs with the lid perimeter recess. When the lid is assembled to the rest of the container, the lid bottom may be configured closer to the container bottom than the lid top, whereby the lid bottom is facing the container bottom and the lid top is facing away from the container bottom. When the lid slides relative to the container, the protruding ball portion may be configured within the channel. When the lid slides whereby a divot is configured over the protruding ball portion of the ball detent, the greater divot depth relative to the channel depth may allow the spring to extend the ball further upwards into the divot, thus securing the lid in its current position.

The lid may be moved from said position by applying an additional force sufficient to cause a contact between the divot and the protruding ball portion that forces the ball to recess further into the fourth container wall, thereby compressing the spring and allowing the lid to slide along the container length whereby the protruding ball portion is configured within the channel and not a divot.

The open position of the lid may occur when the ball detent receiver open end is configured above the protruding ball portion. The shape and location of the ball detent receiver open end may allow the lid to be initially slid onto the rest of the container. The end of the ball detent receiver opposite the ball detent receiver open end ("the ball detent receiver closed end") may exist as one of the divots ("the last divot"). The shape and location of the closed end of the ball detent receiver may prevent the lid from sliding off the second container wall.

Each divot of the lid bottom may correlate with a partially closed lid position and the closed lid position. For example, in embodiments wherein the lid has an open position, a closed position, and 4 partially closed positions, the lid bottom may have 5 divots. The last divot may be the divot that corresponds with the closed position.

The lid may be initially assembled onto the rest of the container by orienting the lid parallel to the container bottom whereby the lid bottom faces the container bottom and the lid top faces away from the container bottom. The ball detent receiver open end may be placed over the protruding ball portion of the ball detent. The lid may then slide whereby the lid is received by the rail recesses and the rail overhangs are received by the lid perimeter recess. The lid may slide along the container length whereby the protruding ball portion of the ball detent exits the ball detent receiver open end and enters the channel. The lid may further slide along the container length whereby the protruding ball portion enters a divot and stops the lid in a partially closed position. An additional force may be applied to the lid whereby the lid continues to slide along the container length whereby the protruding ball portion exits the divot and enters the channel. At least a portion of the additional force may be in a direction parallel to the container bottom. The ball may enter any number of divots along the channel until the ball enters the last divot, whereby the lid is configured in a closed position.

The lid may be configured solely at the container top. The lid may be shaped and configured whereby no portion of the lid extends down any of the four container walls toward the container bottom.

The lid top may have a track pad that may be made of a material with a greater coefficient of friction than the rest of the lid. The track pad may further have a greater coefficient of friction than other components of the container, such as but not limited to the rails, container walls, and compartment walls. The track pad may be flush with the lid top. The track pad may alternatively extend from the lid top. The track pad may alternatively be recessed within the lid top. A user may place their finger on the track pad and move their finger in the direction in which they wish the lid to slide in order to slide the lid relative to the rest of the container. The coefficient of friction of the track pad allows the user to complete this action without the user's finger sliding off the track pad. When the additional force is applied to the lid to whereby the protruding portion of the ball detent exists a divot and enters a channel, thereby moving the lid from a closed or partially closed position, the additional force may be applied to the track pad.

An advantage of using the ball detent and ball detent receiver together as a closure mechanism for the container as described herein may be the structural integrity of said closure mechanism. The forces applied to the closure mechanism are mostly absorbed by the spring, which, as a linear coil spring, is designed to absorb such forces. Other closure mechanisms for similar containers may exist in the art wherein forces are applied to closure mechanisms that contain stress concentrators such as snap features. These closure mechanisms with stress concentrators are prone to breaking when subjected to high forces.

The container walls, container bottom, and compartment walls may be made of metal. Said metal may be a metal that is known to be biocompatible such as but not limited to 6061-T6 aluminum, 17-4 stainless steel, 18-8 stainless steel, 300-series stainless steel, 400-series stainless steel, cobalt-chrome, or titanium. The lid may be the same material as the container walls, container bottom, and compartment walls. Alternatively, the lid may be a different material than the container walls, container bottom, and compartment walls to prevent galling when the lid slides relative to the container. In such embodiments, the lid may be made of a metal. Said metal may be a metal that is known to be biocompatible such as but not limited to 6061-T6 aluminum, 17-4 stainless steel, 18-8 stainless steel, 300-series stainless steel, 400-series stainless steel, cobalt-chrome, or titanium.

The track pad may be made of a material with a greater coefficient of friction that the lid such as but not limited to rubber, silicone, ethylene-propylene, or polyurethane. The track pad may have ridges that extend upwards from the rest of the track pad away from the lid. The track pad may further have depressions that extend downwards from the track pad towards the lid bottom. The ridges and depressions of the track pad may further increase the coefficient of friction of the track pad.

DETAILED DESCRIPTION

The description provided herein describes example embodiments of the present invention and is not intended to limit the invention to any particular embodiment, feature, size, shape, design, material, or any other property. Furthermore, the figures provided herein show example embodiments of the present invention and are not intended to limit the invention to any particular embodiment, feature, size, shape, design, material, or any other property.

Figure 1:
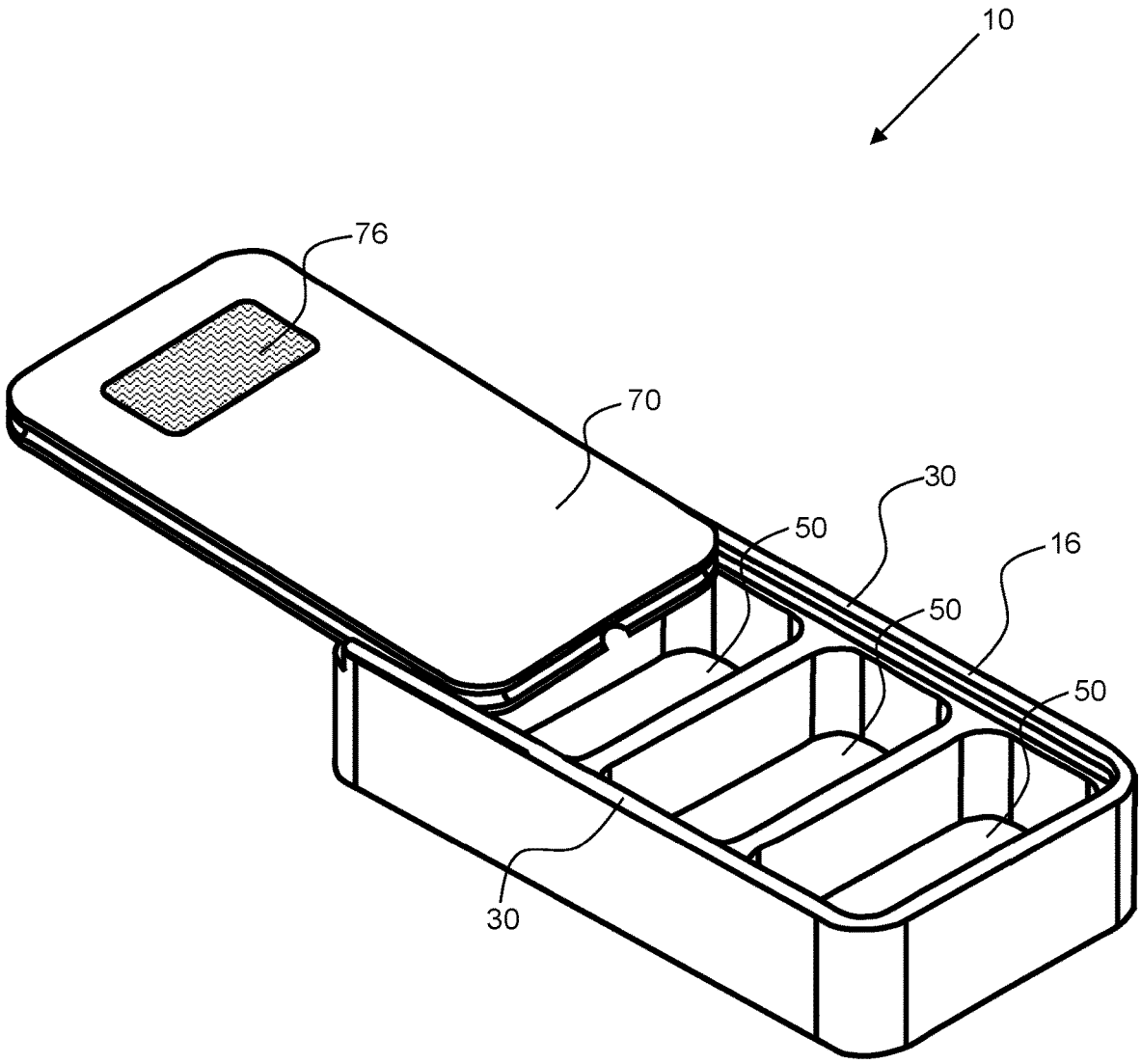
FIG. 1 is a top front perspective view of a container showing a lid that is configured to expose three compartments.

As shown in FIG. 1, a lid 70 of a container 10 is received by two rails 30 that are each configured at a container top 16. The lid 70 is configured whereby three compartments 50 are exposed via the container top 16. A track pad 76 is configured on the lid 70. The compartments 50 are arranged in a linear pattern whereby the lid 70 may be closed to conceal one or more compartments 50. The lid 70 may also be opened or partially opened to expose one or more compartments 50. As shown in FIG. 1, the lid 70 is partially opened since it fully exposes two of the three compartment 50 and partially exposes one of the three compartments 50.

Figure 2:
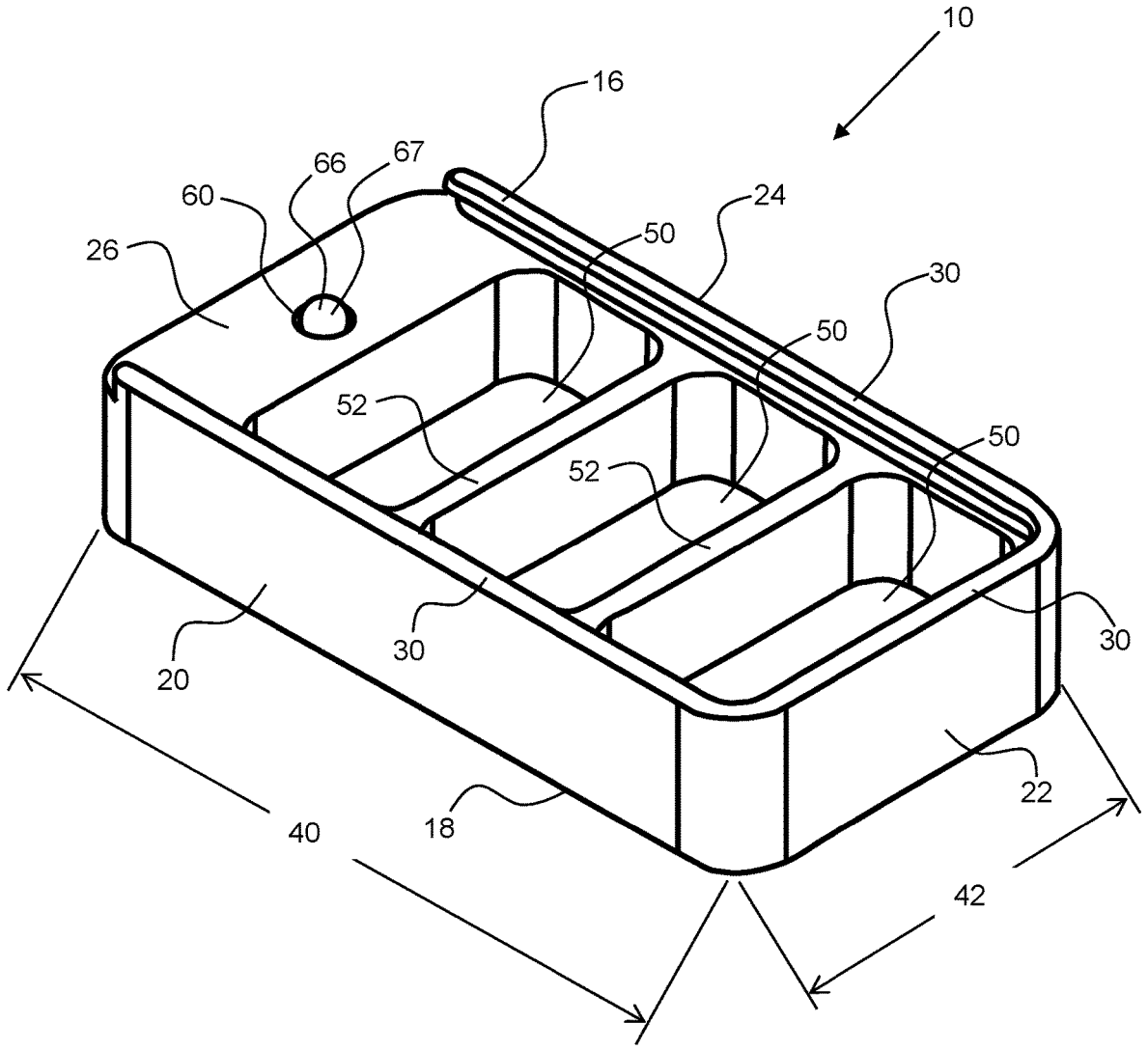
FIG. 2 is a top front perspective view of a container with the lid removed to expose three compartments and a protruding ball portion of a ball detent.

As shown in FIG. 2, the container 10 has four walls: a first container wall 20, a second container wall 22, a third container wall 24, and a fourth container wall 26. The container 10 has a container bottom 18 opposite the container top 16. The container 10 has a container length 40 that extends along the first container wall 20 and third container wall 24. The container 10 has a container width 42 that extends along the second container wall 22 and fourth container wall 26. Rails 30 extend from the first container wall 20, second container wall 22, and third container wall 24 at the container top 16. The rails 30 are connected to form a monolithic structure with the container walls.

The fourth container wall 26 is thicker than the other three container walls. This allows a ball detent 60 to be configured within the fourth container wall 26. A protruding ball portion 67 of a ball 66 of the ball detent 60 extends from the fourth container wall 26.

The compartments 50 are configured within the four container walls. The compartments 50 are separated by compartment walls 52 that extend from the first container wall 20 to the third container wall 24. The compartment walls 52 extend perpendicular to the first container wall 20 and third container wall 24, and parallel to the second container wall 22 and fourth container wall 26. As shown in FIG. 2, the container 10 has three compartments 50, and therefore two compartment walls 52.

Figure 3:
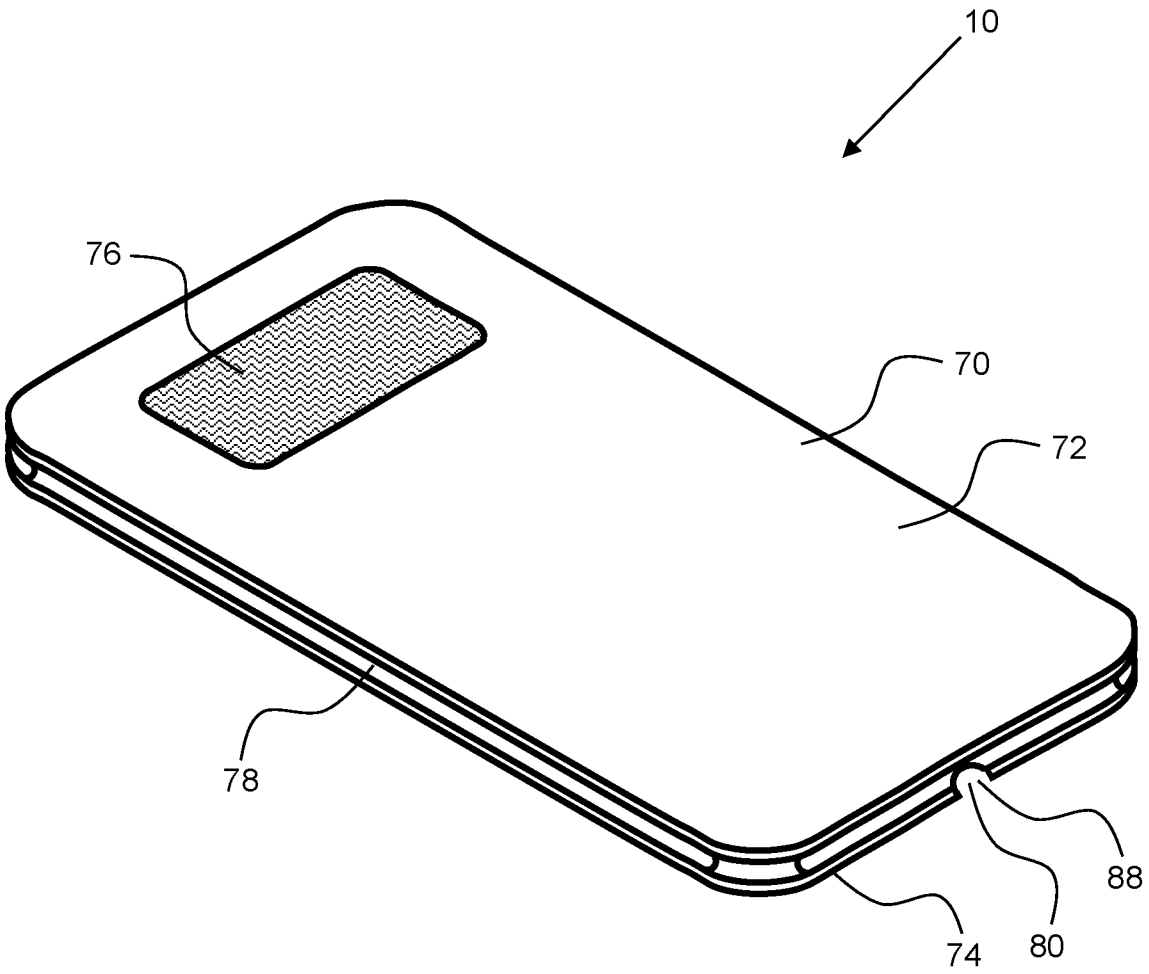
FIG. 3 is a top front perspective view of a lid of a container.

As shown in FIG. 3, the lid 70 has a lid top 72 on which the track pad 76 is configured. A lid bottom 74 is configured opposite the lid top 72. A ball detent receiver 80 is configured within the lid bottom 74. A ball detent receiver open end 88 exposes the ball detent receiver 80 at one end of the lid 70. The lid 70 has a lid perimeter recess 78 configured along the perimeter of the lid 70. The lid perimeter recess 78 may allow the lid 70 to be received by the rails of the container.

Figure 4:
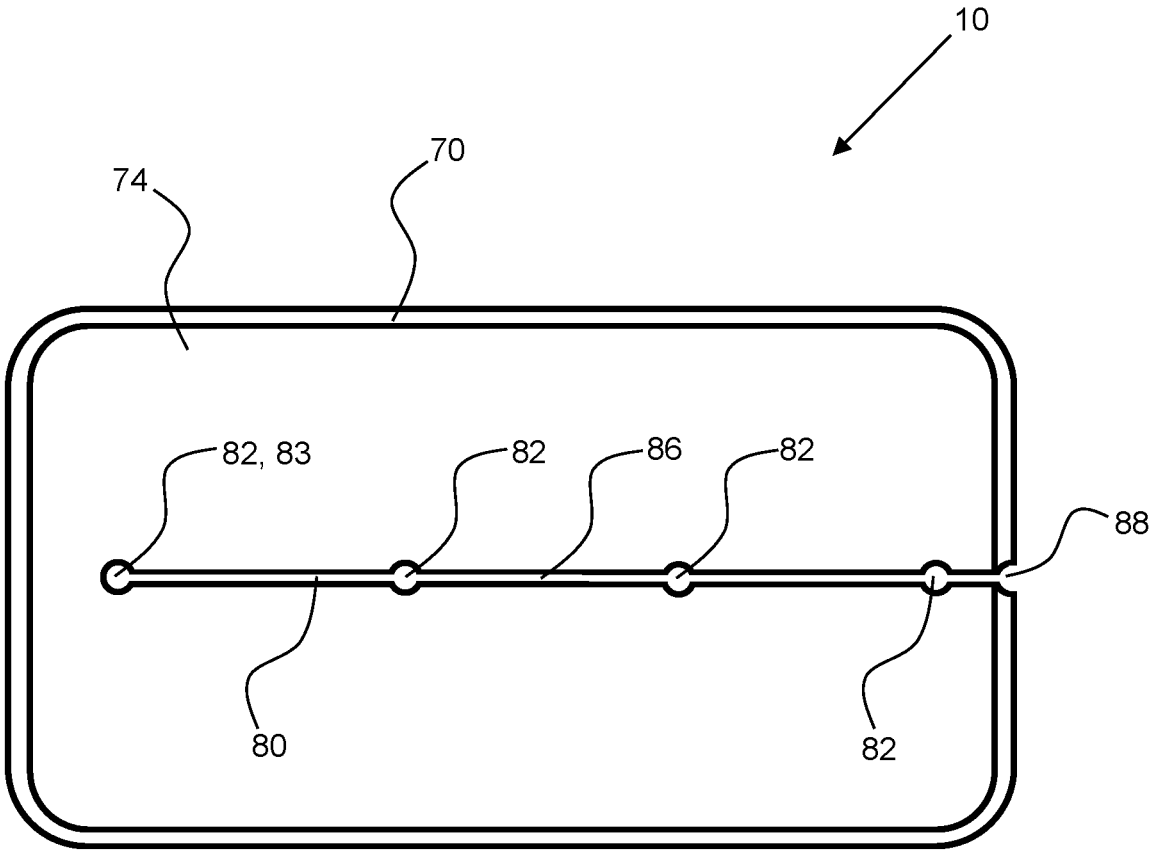
FIG. 4 is a bottom view of a lid of a container showing a ball detent receiver of the lid.

As shown in FIG. 4, a ball detent receiver 80 is configured within the lid bottom 74. Four divots 82 are configured in a linear pattern along a channel 86 of the ball detent receiver 80. The divots 82 and channel 86 are recessed into the lid 70. The number of divots 82 is four since the number of corresponding compartments (not shown in FIG. 4) of the container is three. The channel 86 starts at a ball detent receiver open end 88, which is configured at one end of the lid 70. The ball detent receiver open end 88 is the shape of half of a divot 82. The channel extends along the lid bottom 74 and ends at one of the divots 82 which is considered the "last divot" 83. The four divots 82 are evenly spaced from one another. The distance along the channel 86 between the ball detent receiver open end 88 and the divot 82 closest to the ball detent receiver open end 88 is less than the distance along the channel 86 between divots 82.

Figure 5:
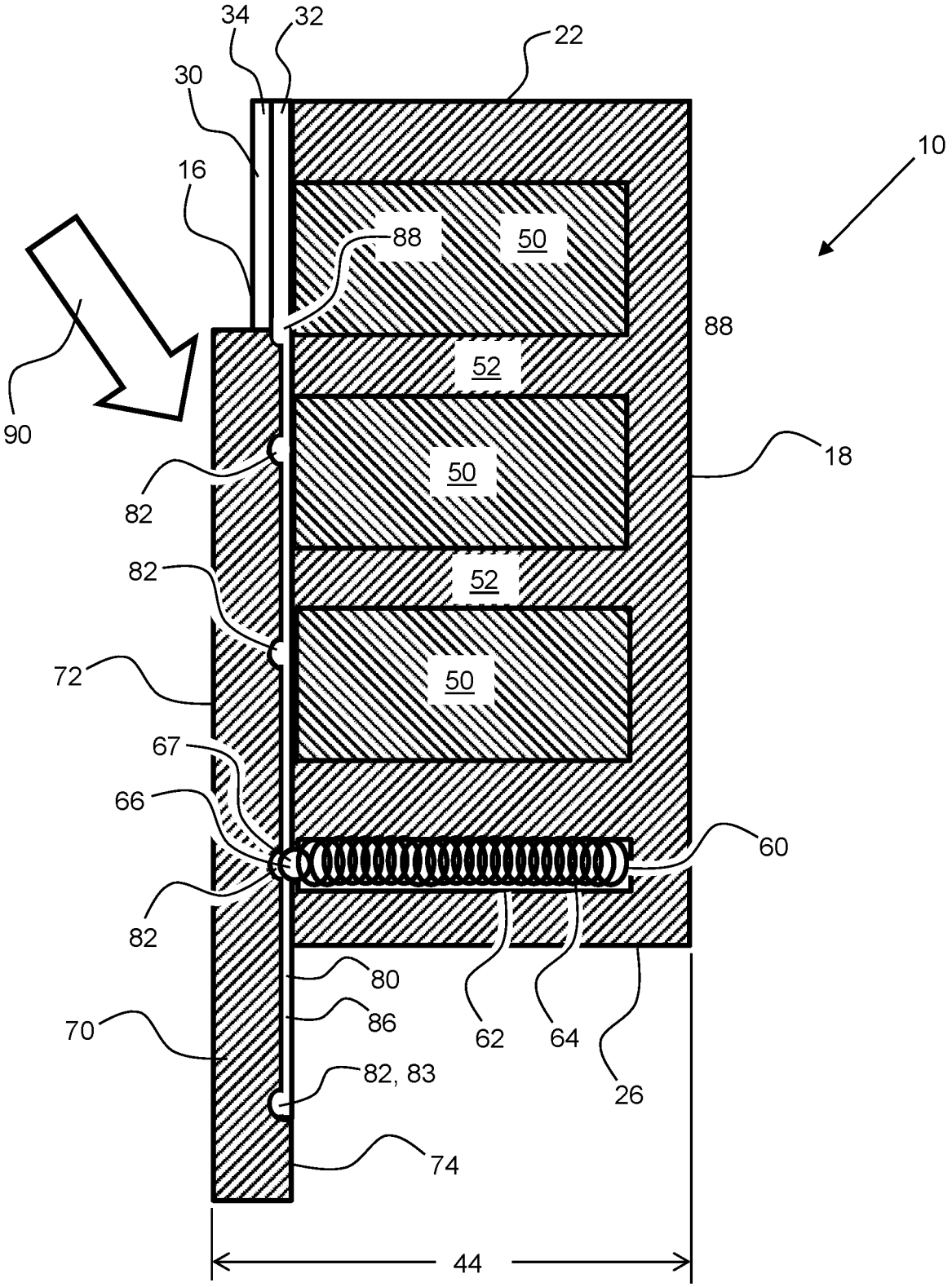
FIG. 5 is a side cross-sectional view of an additional force being applied to a lid of a container to move the lid thereby exposing compartments of the container.

As shown in FIG. 5, the container 10 has a container height 44 which extends from the container bottom 18 to the container top 16. Since the lid 70 is configured on the container top 16 in FIG. 5, the container height 44 extends from the container bottom 18 to the lid top 72.

The ball detent receiver 80 is configured within the lid bottom 74. The channel has a depth that extends from the lid bottom 74 towards the lid top 72. The divots 82 and ball detent receiver open end 88 also have depths, which extend from the lid bottom 74 further towards the lid top 72 than the corresponding depth of the channel 86.

The ball detent 60 is configured within the fourth container wall 26. A spring 64 of the ball detent 60 is configured within a ball detent recess 62 of the ball detent 60. The ball 66 is configured at one end of the spring 64 and is biased towards the lid top 72 by the spring 64. The protruding ball portion 67 is thereby configured within the ball detent receiver 80 at the lid bottom 74. The lid 70 may slide relative to the container bottom 18, wherein the protruding ball portion 67 is configured within the channel 86. When the lid slides whereby a divot 82 is configured above the ball 66 of the ball detent 60, the greater depth of the divot 82 than the channel 86 allows the protruding ball portion 67 to enter the divot 82 since the ball 66 is biased towards the lid top 72 by the spring 64. The protruding ball portion 67 being configured within the divot 82 stops the lid 70 from sliding, thereby causing the lid to be configured in a stopped position. As shown in FIG. 5, the stopped position is a partially closed position since one of the compartments 50 is exposed while other compartments 50 are concealed.

The lid 70 may continue sliding (may be moved from a stopped position) if an additional force 90 is applied to the lid. At least a portion of the additional force 90 must be in the direction in which the lid is desired to slide in order to slide the lid past a divot 82. The additional force 90 must be sufficient to cause a contact between the divot 82 and the protruding ball portion 67 whereby the ball 66 recesses further into the ball detent recess 62, thereby compressing the spring 64 and allowing the lid to slide relative to the container bottom 18 whereby the protruding ball portion 67 is configured within the channel 86 and not a divot 82.

Figure 6:
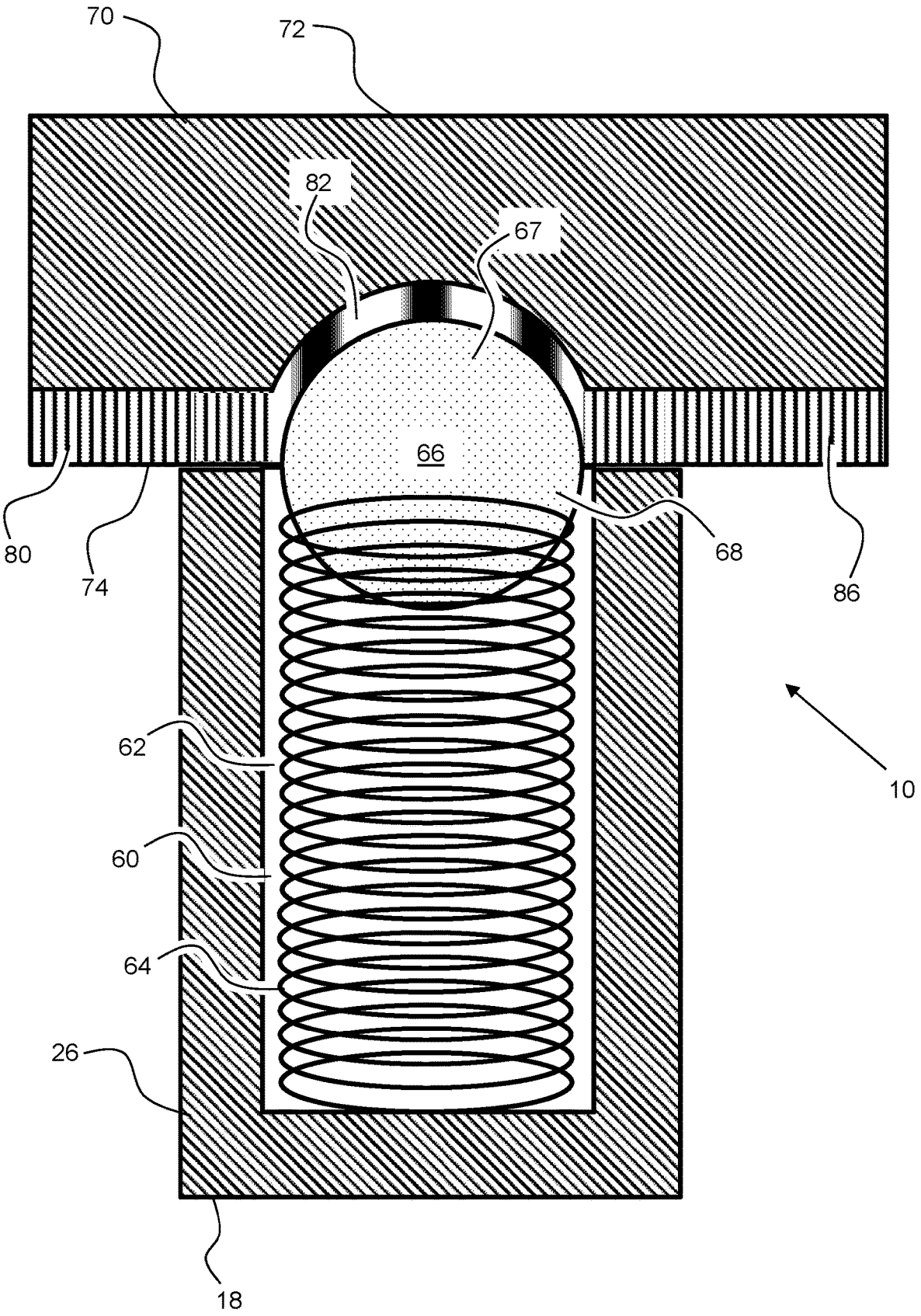
FIG. 6 is a partial side cross-sectional view of a lid of a container being retained in a position by a ball detent.

As shown in FIG. 6, the protruding ball portion 67 of the ball 66 is configured within a divot 82 of the ball detent receiver 80. A recessed ball portion 68 is configured within the ball detent recess 62 of the ball detent 60. The protruding ball portion 67 is the portion of the ball 66 that protrudes from the ball detent recess 62, and the recessed ball portion 68 is the portion of the ball 66 that is recessed within the ball detent recess 62. The protruding ball portion 67 and the recessed ball portion 68 change based on the position of the ball 66 relative to the container bottom 18. As the spring 64 causes the ball 66 to move away from the container bottom 18, more of the ball 66 protrudes from the ball detent recess 62, and therefore the protruding ball portion 67 increases and the recessed ball portion 68 decreases. When force is applied to the lid in order to move the lid from a stopped position, more of the ball 66 is recessed into the ball detent recess 62, and therefore the protruding ball portion 67 decreases and the recessed ball portion 68 increases. The spring 64 expands to cause the ball 66 to protrude further out of the ball detent recess 62. The spring 64 is compressed when the ball 66 is forced to recede further into the ball detent recess 62.

Figure 7:
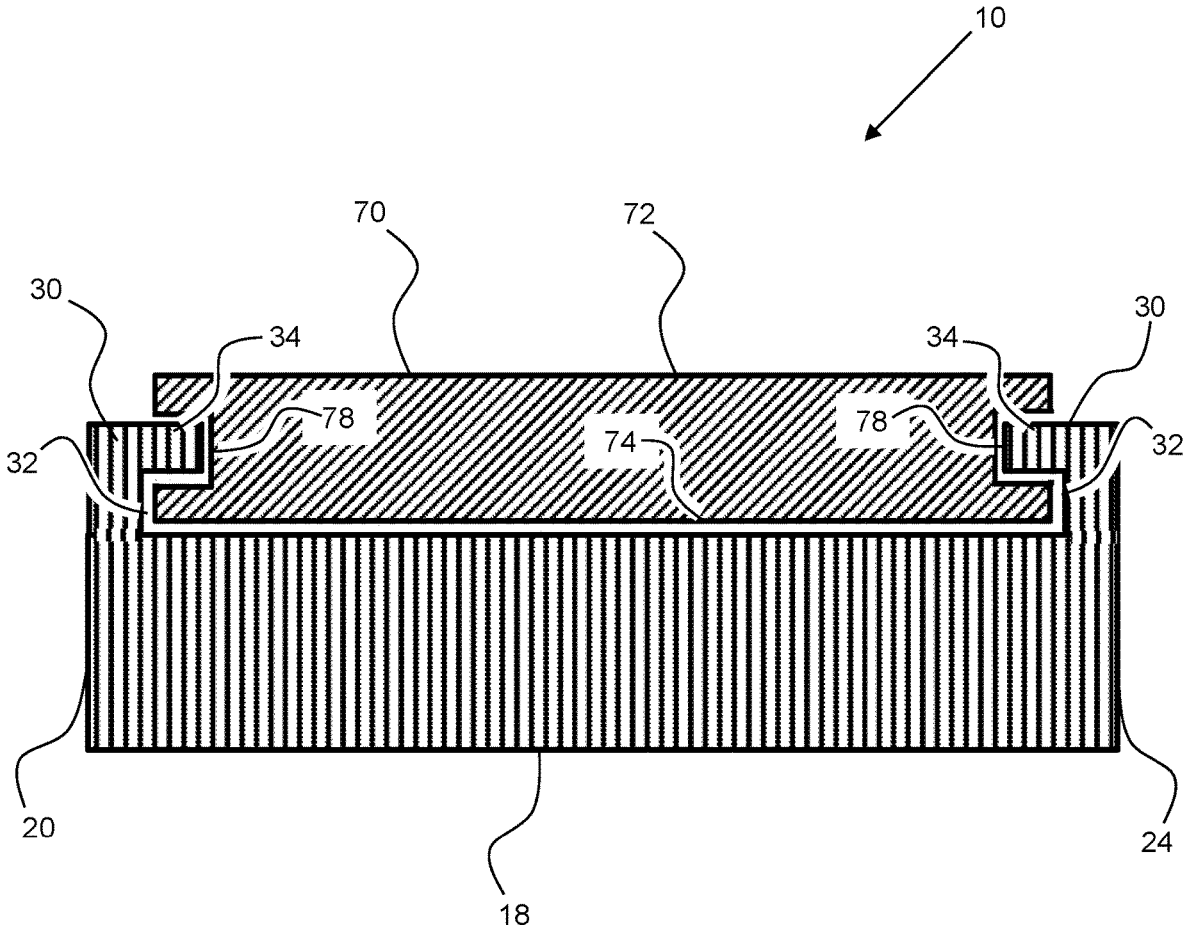
FIG. 7 is a front cross-sectional view of a lid assembled to the rest of a container by rails of the container and a lid perimeter recess of the lid.

As shown in FIG. 7, the rails 30 of the container 10 each have a rail recess 32 and a rail overhang 34. The rail overhangs 34 extend from the container walls (the first container wall 20 and third container wall 24 as shown in FIG. 7) parallel to the container bottom 18. The rail recesses 32 receive the lid bottom 74 to secure the lid 70 to the rest of the container 10. The lid top 72 is configured the opposite side of the rail overhangs 34 than the lid bottom 74. The lid perimeter recess 78 is configured between the lid top 72 and lid bottom 74. The lid perimeter recess 78 receives the rail overhangs 34 to further secure the lid 70 to the rest of the container 10.

What is claimed is:

1. A container comprising:

four container walls comprising:

a first container wall;

a second container wall configured perpendicular to the first container wall;

a third container wall configured parallel to the first container wall;

a fourth container wall configured perpendicular to the first container wall;

a container top;

rails configured at the container top and extending along the first container wall, second container wall, and third container wall, the rails each having a rail recess and a rail overhang;

a container bottom opposite the container top;

a container length extending from the second container wall to the fourth container wall;

compartments configured within the container, wherein the compartments are configured linearly along the container length;

compartment walls configured parallel to the second container wall and fourth container wall, the number of compartment walls being 1 less than the number of compartments;

a ball detent configured within the fourth container wall, the ball detent comprising:

a ball detent recess;

a spring configured within the ball detent recess;

a ball comprising:

a protruding ball portion protruding from the fourth container wall at the container top;

a recessed ball portion configured inside of the ball detent recess;

a lid comprising:

a lid top;

a lid bottom opposite the lid top;

a ball detent receiver configured at the lid bottom, the ball detent receiver comprising:

a channel;

divots configured linearly along the channel, the number of divots being 1 greater than the number of compartments; and a ball detent receiver open end;

wherein the lid is received by the rail recesses of at least two of the rails, whereby the lid slides along the container length parallel to the container bottom;

wherein the protruding ball portion of the ball is received into the ball detent receiver by the ball detent receiver open end, wherein the protruding ball portion is configured within the channel as the lid slides along the container length, wherein the protruding ball portion enters at least one divot, whereby the lid stops sliding along the container length unless an additional force is applied to the lid, whereby at least one of the containers is exposed via the container top;

wherein multiple containers are exposed as the lid continues to slide along the container length.

2. The container of claim 1, further comprising a track pad configured on the lid top, wherein the track pad has a coefficient of friction that is greater than corresponding coefficients of friction of the other portions of the container.

3. The container of claim 1, wherein the number of compartments is at least 2.

4. The container of claim 1, wherein the number of compartments is at least 4.

5. The container of claim 1, wherein the number of compartments is at least 7.

6. The container of claim 1, wherein the number of compartments is at least 9.

7. The container of claim 1, further comprising:

a container width extending from the first container wall to the second container wall; and a container depth extending from the container top to the container bottom.

8. The container of claim 7, wherein the container width is 1 inch or more.

9. The container of claim 7, wherein the container width is 1.5 inches or more.

10. The container of claim 7, wherein the container width is 2 inches or more.

11. The container of claim 7, wherein the container depth is 0.75 inches or more.

12. The container of claim 7, wherein the container depth is 1 inch or more.

13. The container of claim 7, wherein the container depth is 1.25 inches or more.

14. The container of claim 1, wherein the lid further comprises a lid perimeter recess, wherein when the lid is received by the rail recesses of at least two of the rails, the rail overhangs of said rails are received by the lid perimeter recess.

15. The container of claim 1, wherein when the additional force is applied to cause the lid to continue sliding along the container length after being stopped by the protruding ball portion of the ball, the additional force is applied to the track pad, wherein at least a portion of the additional force is applied in a direction parallel to the container bottom.

16. The container of claim 1, wherein the lid is configured solely at the container top, and wherein no portion of the lid extends down any of the four container walls towards the container bottom.

17. The container of claim 1, wherein the ball detent receiver comprises a last divot configured at an opposite end of the ball detent receiver than the ball detent receiver open end, wherein when the lid slides along the container length whereby the protruding ball portion enters the last divot, the lid is configured in a closed position.

* * * * *